United States Patent [19]

Hickok

[11] Patent Number: 4,848,404

[45] Date of Patent: Jul. 18, 1989

[54] HYDRAULIC VALVE

[76] Inventor: Doyle Hickok, 2 Elizabeth Close, Maida Vale, London, England

[21] Appl. No.: 149,016

[22] Filed: Jan. 27, 1988

[30] Foreign Application Priority Data

Feb. 18, 1987 [GB] United Kingdom ..... 8703800

[51] Int. Cl.[4] ..... F15B 13/043

[52] U.S. Cl. ..... 137/625.64; 91/426; 137/625.66

[58] Field of Search ..... 91/426; 137/625.64, 137/625.66

[56] References Cited

U.S. PATENT DOCUMENTS

| | | | |
|---|---|---|---|
| 3,139,908 | 7/1964 | Strader | 137/625.69 X |
| 3,980,336 | 9/1976 | Bitonti | 91/426 X |
| 4,041,983 | 8/1977 | Bianchetta | 137/625.66 X |
| 4,046,165 | 9/1977 | Rose et al. | 137/625.66 X |
| 4,467,833 | 8/1984 | Satterwhite et al. | 91/426 X |
| 4,526,202 | 7/1985 | Chorkey . | |
| 4,649,957 | 3/1987 | Quinn | 137/625.66 X |

FOREIGN PATENT DOCUMENTS

| | | |
|---|---|---|
| 6900384 | 4/1953 | United Kingdom . |
| 727976 | 4/1955 | United Kingdom . |
| 1365976 | 9/1974 | United Kingdom . |
| 1500713 | 2/1978 | United Kingdom . |
| 1594783 | 8/1981 | United Kingdom . |

*Primary Examiner*—Gerald A. Michalsky

*Attorney, Agent, or Firm*—Kerkam, Stowell, Kondracki & Clarke

[57] ABSTRACT

A bistable slide valve 10 (FIG. 1) has a slide member 12 moved between operating positions by short control fluid pulses and has a safety shut-off for supply pressure failure in the form of safety spring 38 opposed by valve supply liquid in line 22 acting on a safety piston 37. Slide member 12 has a through-aperture 29 connecting supply and function lines 22, 23 when the valve is open and venting the function line via slide chamber 12 to return line 24 when the slide member is displaced. Safety shut off, less dependent upon indeterminate frictional resistance of the slide member, is achieved by a stronger safety spring and greater liquid-derived restraining force so that the frictional resistance force is a small proportion of the total restraining force, with smaller variations in residual pressure at which the safety means operates. To prevent a low friction slide member from being displaced by external shocks a holding piston 46 in cylinder 47 receives supply liquid by port 49 when the slide member is in the valve open position but vented directly into the slide chamber when the slide member is moved. The holding force exerted by the piston is less than the normal valve force of the control pulse and direct venting into the slide chamber ensures no residual holding pressure re-opens the valve after the control pulse has ended.

3 Claims, 3 Drawing Sheets

HYDRAULIC VALVE

Figure 1:
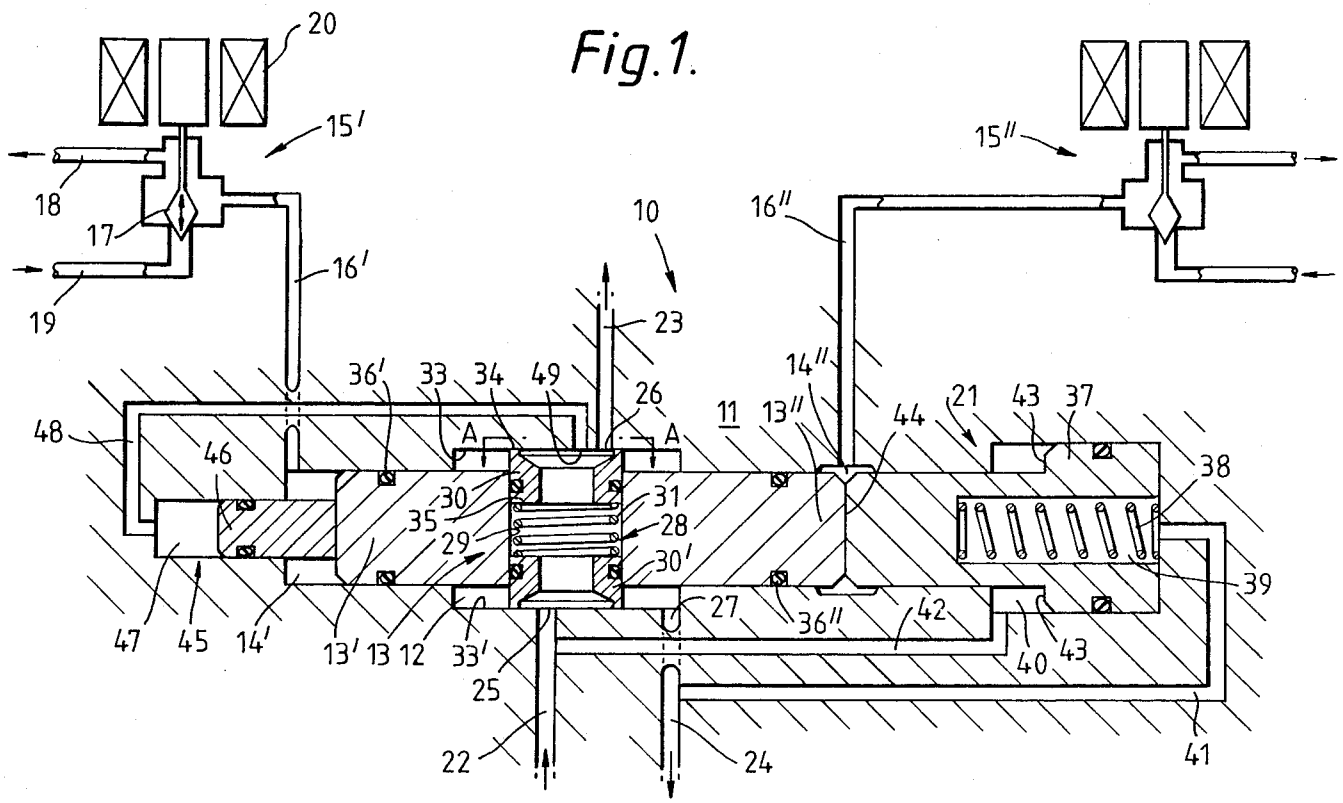

This invention relates to hydraulic valves and particularly to bistable slide valves in which a valve member is movable by transient control forces between two operating positions to control the application of liquid, supplied at elevated pressure, to functioning apparatus and containing safety means for returning the valve member to a datum or 'closed' position upon failure of the liquid supply pressure.

Such valves are sometimes used as selector valves in oil production plant serving to determine by their operating state, the position of the valve member, whether an hydraulic actuator is pressurised or depressurised.

Such actuators are often located in inaccessible places and may be retained in either state of pressurisation for long periods of time. Accordingly, the selector valve, which is usually mounted near the actuator and determines actuator fluid pressure, must also retain its operating position for considerable periods of time without maintenance but operate reliably when required, the important maintenance aspect being low leakage of the pressurised liquid being controlled over long periods and the important reliability aspect being the ability to operate according to design even after long period of inactivity.

One form of valve suitable for such use is the slide valve in which an apertured slide member controls the passage of actuator control liquid from a pressured supply to actuator apparatus and from actuator apparatus to an unpressured return by displacement of the slide member across the flow directions of the liquid. The slide member may be made unsusceptible to displacement by the liquids passing therethrough and require to be acted upon only for displacement to the alternative operating position.

The slide member may be formed for such sliding with piston formations at each end and reciprocable within separate cylinders, each cylinder being supplied one at a time with a transient control 'pulse' of pressurised fluid by way of remote electrically operated pilot valve means to displace its piston formation and push the slide member into its other operating position whereupon the control pulse of fluid pressure is vented. Such control of slide member position by temporarily raised fluid pressure is simple to implement and because fluid pressure is not maintained between operations problems associated with fluid leakage are mitigated.

It is also known for the pressurised liquid whose flow is being controlled by the valve to be contained in the valve by metal-to-metal seals which satisfy requirements of low leakage and low maintenance but provide an uncertain degree of friction to member sliding which may affect reliability of valve functioning, particularly of the safety means, the degree of friction being dependent upon the lubricity of the liquid being controlled thereby and in contact with the seals.

The safety means is often a spring or spring loaded member biased to contact the slide member, and push it to a position in which the pressurised supply is decoupled from the actuator load and the load depressurised, but normally restrained against the safety bias force of the spring by liquid from the pressurised supply so that the slide member can be controlled to assume both operating positions. A commonly employed form of spring loaded member is a safety piston on which supply liquid acts.

It is intended that the safety means be tripped by a fall in valve supply liquid pressure below a predetermined (and usually low) safety tripping valve, whereupon the safety bias force of the spring on the safety piston exceeds that of the supply liquid on the piston, and the slide member is returned to the valve-closed postion to depressurise the actuator.

The resistance to movement of the slide member by the bias spring is a combination of the force of supply liquid on the safety piston and frictional and any other resistance to sliding by the slide member and the safety piston. Such other resistance may, for example, be due to displacement of unpressurised control fluid used to place the slide member in the first operating position and it is convenient to consider all such resistances to motion for any valve as part of the frictional resistance of the slide member and the term 'frictional resistance' is used in the specification to include all such sources of resistance to slide member displacement other than due to specifically applied forces and represents the force which must be applied to the slide member to overcome these.

It will be appreciated that the force exerted by the spring must exceed any frictional resistance of the slide member and thus exceed its maximum value. However, if the slide member has a low frictional resistance the spring causes the safety means to be operated whilst the supply liquid pressure providing the spring restraining force is at too high a level.

In this respect it is the indeterminate level of the frictional resistance which causes difficulties in establishing acceptable tripping of the safety means, particularly in terms of defining repeatedly a sufficiently low residual supply liquid pressure above which the safety means will not trip erroneously.

It is undesirable for the safety means to be tripped at too high a residual supply pressure, particularly where such a pressure is within the range of acceptable supply pressure fluctuations, and avoidance of this is often associated with low bias force from the spring.

It will be appreciated that whatever the level of frictional resistance to sliding the spring force must exceed it throughout the displacement, even when the spring is extended and exerting less force than when contracted prior to tripping of the safety means, and this difference has to be provided by the supply liquid determining, with safety piston on which it acts, the residual supply pressure.

As outlined above other considerations of maintenance and reliability favour the use of metal-to-metal seals but the frictional effects of such seals, although they may be lower than with other materials, depend greatly upon the lubricity of the liquid with which they are used and must be considered as providing a wider range of frictional values for any seal structure and making the slide member frictional resistance attributable to the valve construction particularly indeterminate.

To mitigate the effect of frictional variation in such a slide member with such seals, rather than the level of the frictional forces per se which are readily countered by the strength of the safety spring, it has been proposed in the past to rely upon a relatively large slide member frictional resistance for which variations thereof represent only a small proportion of the resistance to reduce the uncertainty in residual supply liquid pressure at which the safety means trips.

The use of a significant frictional resistance is considered additionally beneficial in reducing any tendency for the slide member, which is unrestrained by valve controlling means between operations, to be displaced by external shocks or other forces, such as gravity, to the detriment of the valve operation.

It is believed that the variations in slide member frictional resistance levels caused by using metal-to-metal seals are too great in relation to that magnitude of overall friction tolerable in permitting normal displacement of the slide member by the control means to enable the residual supply liquid pressure at which the safety means operates to be defined with a degree of accuracy facilitating operation at a low residual supply liquid pressures.

It is an object of the present invention to provide a bistable hydraulic slide valve with low-supply-pressure safety means for which variation in the residual supply pressure at which the safety means trips is less influenced by variations in frictional resistance of the slide member than with known arrangements.

According to the present invention a bistable hydraulic slide valve comprising a body including a slide chamber having supply, return and function ports to which supply, return and function lines respectively are connected, an apertured slide member reciprocable in the slide chamber between a first operating position, at which the function port is coupled to the supply port, and a second operating position, at which the function port is coupled to the return port, valve control means responsive to control signals when the slide member is in one operating position to apply an operating force at least temporarily to the slide member to slide it to the alternative operating position, safety means including a safety spring operable to exert a safety bias force in a direction to move the slide member from the first operating position and safety piston means responsive, at least when the slide member is in the vicinity of the first operating position, to a supply liquid pressure thereon greater than a safety tripping value to exert a restraining force on the safety spring greater than the spring safety bias force, and characterised by slide member position holding means comprising a holding piston disposed in a holding cylinder and holding control means, comprising a holding port into the slide chamber and a liquid flow line between the holding port and the holding cylinder, responsive to the slide member being at least in the vicinity of the first operating position to couple the holding cylinder to fluid from the supply port at a pressure which exerts by separation of holding piston and cylinder a holding force biasing the slide member to the first operating position which, upon operation of the valve, is less than normal valve operating forces applied to the slide member and responsive to the slide member being displaced from said vicinity of the first operating position by said valve operating forces to vent the holding cylinder fluid pressure into the slide chamber and eliminate the holding bias force.

Figure 2:
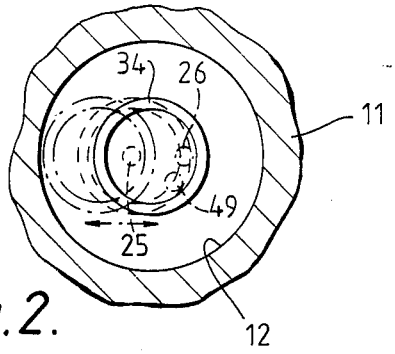
Figure 5:
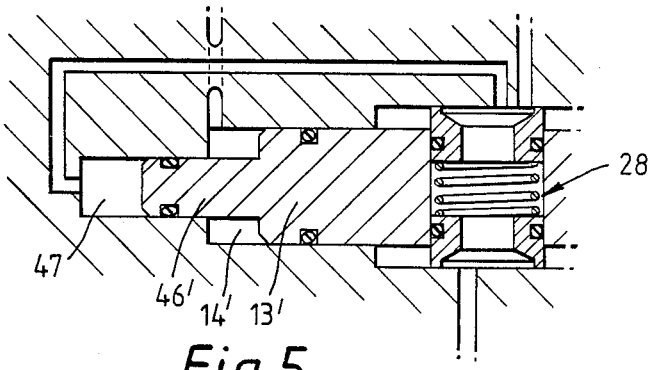
Figure 6:
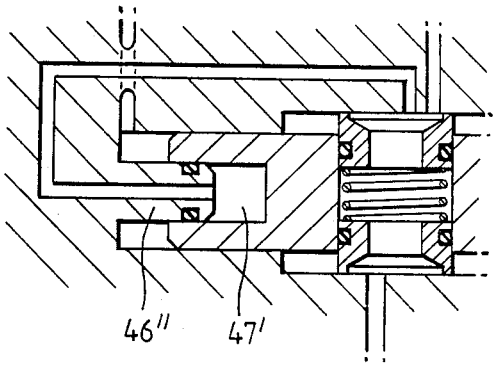
Figure 3:
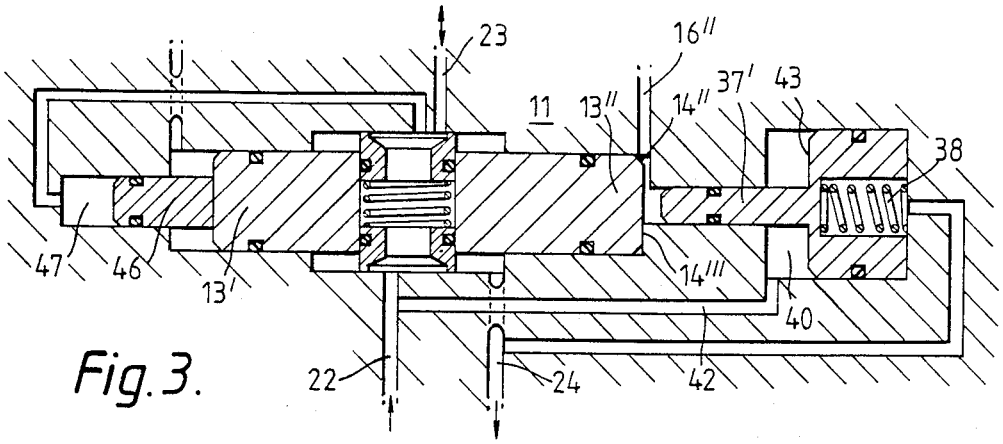
Figure 4A:
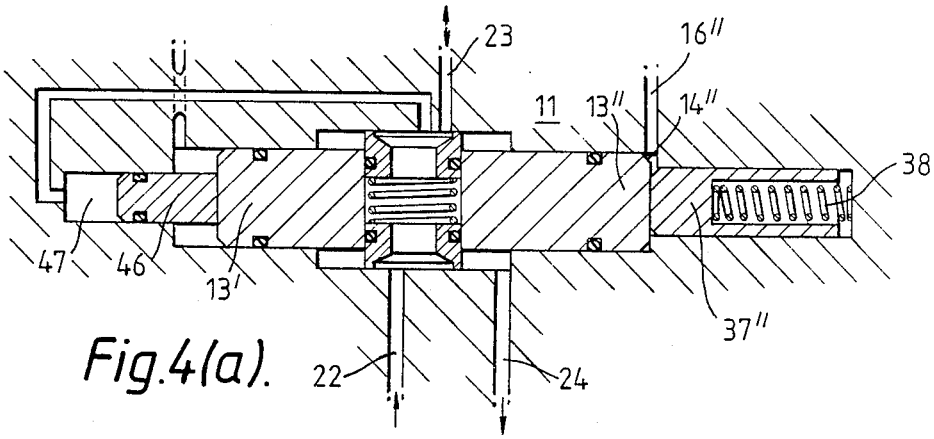
Figure 4B:
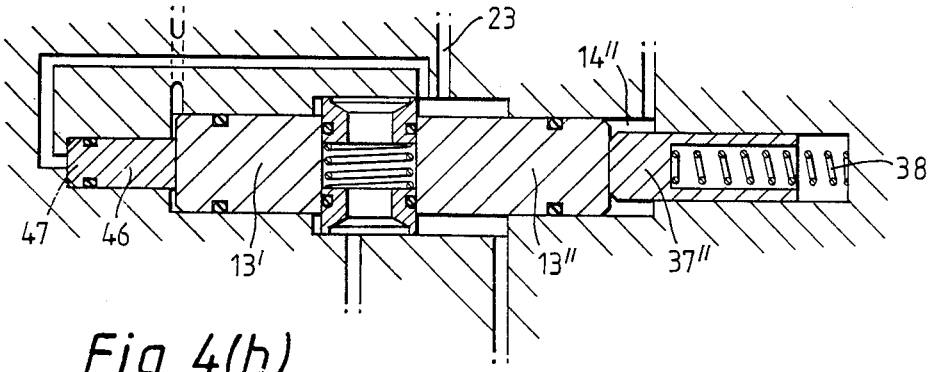

Embodiments of the invention will now be described by way of example with reference to the accompanying drawings, in which:

FIG. 1 is a sectional elevation through a bistable hydraulic slide valve according to the present invention showing slide member position holding means, FIG. 2 is a cross-sectional view along the line A—A of FIG. 1, FIG. 3 is a sectional elevation through a bistable hydraulic slide valve similar to FIG. 1 but showing an alternative safety means structure, FIG. 4(*a*) is a sectional elevation through a bistable hydraulic slide valve showing yet another form of safety means structure, the valve slide member being in a first operating position, FIG. 4(*b*) is a section elevation through the valve of FIG. 4(*a*) but showing the slide member in a second operating position, FIG. 5 is a sectional elevation through part of a bistable hydraulic slide valve similar to FIG. 1 but detailing an alternative form of slide member position holding means, and FIG. 6 is a sectional elevation through part of a bistable hydraulic slide valve similar to FIG. 5 but detailing yet another form of slide member position holding means.

Referring to FIG. 1 the valve shown generally at 10 comprises a metal body 11 containing a slide chamber 12 across which an apertured slide member 13 is reciprocable between two operating positions, a first, or valve-open, position in which the slide member is shown in the Figure and a second, or valve-closed, position in which the slide member is to the left of the position shown in the Figure.

The slide member 13 is moved between the two operating positions by valve control means which includes piston formations 13', 13'' at opposite ends of the slide member and corresponding cylinders 14', 14'' to contain them. The valve control means also includes pilot valve means in the form of two solenoid valves 15', 15'' having fluid connecting lines 16', 16'' to the cylinders 14' and 14'' respectively.

Each valve, say 15', contains a poppet valve member 17 which normally connects the line 16' to a return line 18, permitting any pressure within fluid in cylinder 14' to vent. The poppet valve member normally closes a pilot supply line 19 which is connected to a source of pressurised fluid, conveniently, but not necessarily, a hydraulic liquid of the type controlled by the valve, but is moved by energisation of a solenoid 20 into an alternative position which connects the line 16' to the pilot supply line 19 and closes its connection to return line 18.

For the duration of the solenoid energisation fluid from the pilot supply line is fed to cylinder 14' and the pressure thereof provides an actuating force to the end of the piston formation 13' which displaces the slide member into the first operating position shown and defined by abutment of the second piston formation 13'' with safety means 21 described hereinafter. The solenoid is energised by a pulse whose duration is sufficient for the pilot supply pressure to completely move the slide member, thereafter the poppet valve member being returned to close the pilot supply line and vent any pressure in the cylinder 14'.

The other solenoid valve 15'' is of identical construction and the valves are arranged to be energisable one at a time only so that as the slide member is displaced by energisation of one valve, say 15', the fluid from cylinder 14'' is displaced via the other valve 15''. This form of control means provides a simple means of applying an actuating force temporarily to the slide member to change its operating position, although any other means of applying such a position controlling force may be employed.

Hydraulic liquid supply, function and return lines 22, 23, 24 respectively are contained with the valve body and are ported into the slide chamber at 25, 26, 27 respectively.

The slide member 13 includes aperture means shown generally at 28. This comprises an aperture 29 extending through the slide member across the direction of slide in the slide chamber, and containing at each end thereof a plunger, or shear, seal 30, 30'. Each shear seal is axially movable in the through-aperture and biased outwardly of the aperture with respect to the other seal by an intermediate resilient member 31, such as a spring, into contact with the opposing walls 33, 33', respectively of the slide chamber. Each shear seal comprises a hollow tubular member of suitable metal having at the ends thereof annular faces 34, 35, the annular face 34 engaging the slide chamber wall forming a sealing land of smaller area than the face 35 within the aperture.

Pressure exerted on the annular face 35 of each seal by the resilient member and particularly pressurised liquid within the aperture means creates a contact pressure between the sealing land 34 and the chamber wall which prevents the leakage of such liquid past the land. The properties and use of plunger or shear seals are known per se and require no further description, the important properties concerning the present invention being that the metal-to-metal seals formed offer good, that is, low leakage, sealing for long periods without maintenance and are capable of offering low resistance to sliding movement if operated within liquid of suitable lubricity.

The supply port 25 is dimensioned and disposed with respect to the aperture means, that is, the circular region defined within the annular sealing land 34 of the shear seal 30', so that the liquid at supply line pressure is ported into the aperture means for all positions of the slide member thereby maintaining the above described sealing pressure on the seal faces. The return line port 27 is disposed in the wall of the slide chamber so that it is outside the aperture means for all positions of the slide member. Referring also to FIG. 2, the function line port 26 is disposed so that when the slide member is in the vicinity of the first operating position, that is, at it or only slightly displaced therefrom towards the second operating position, the function port is encircled by the annular land 34 of shear seal 30 and communicates with the supply port by way of the aperture means.

The function port is adjacent the annular sealing land and as the slide member, and sealing land, are displaced from the first operating position the shear seal 30 soon fails to encircle the function port which then communicates with the slide chamber in general and the return port 27 to vent liquid pressure on any actuator load, such as connected to the function line.

The construction of aperture means utilises supply liquid pressure to effect sealing between the supply line/aperture means and the slide chamber in general and by using free floating shear seals permits these to exert a balanced sealing force on the slide chamber without any lateral force on the slide member itself which could interfere with its free sliding in the chamber and optimises any low sliding resistance characteristics of the slide member. It will also be seen that the high liquid pressure associated with supply line 22 is isolated from the slide chamber which has only to be sealed against pressures associated with the return line. In practice seals 36' and 36'', sealing both slide chamber and control cylinders 14' and 14'', are chosen in accordance with the transient control actuating pressures experienced within the control cylinder.

The safety means 21 comprises a hollow differential area safety piston 37, containing a bias spring 38 in a chamber 39, reciprocable in a safety cylinder 40. The cylinder has one line 41 connected to valve return line 24 and another line 42 connected to the valve supply line 22.

The head 44 of the safety piston, when in its normally held position shown, forms an end wall of control cylinder 14'' and defines the first operating position of the slide member. The head of the safety piston is also dimensioned the same as the piston formation 13'' of the slide member so that if the supply line pressure falls sufficiently the bias spring 38 can extend and force the safety piston 37 to move through the control cylinder 14'' and displace the slide member to its second (or valve-closed) operating position.

The valve thus far described is conventional as far as the normal control and safety functions, if not construction, are concerned; the construction being one offering reliability and low maintenance by virtue of the sealing arrangement and control means.

In accordance with the present invention it is intended that the opposing safety bias force of the spring and the restraining force of the piston, at the residual supply pressure which represents the safety tripping value, will be much larger than the maximum frictional resistance force of the slide member, the value of which frictional resistance is not of paramount importance but preferably lower rather than larger within the understanding that the actual effective frictional resistance value will vary indeterminately within a range of values with the supply liquid.

The force needed of the safety spring to overcome the frictional resistance is effectively added to the supply liquid-derived restraining force opposing the spring bias and by using a stronger spring, the component of the force it overcomes, in tripping the safety means, which is due to the frictional resistance, however indeterminate, is a smaller proportion of the total force opposing the safety spring bias. Accordingly the liquid-derived restraining force at which the safety spring force is able to prevail is varied to a proportionately lesser degree by variation in the frictional resistance notwithstanding that the liquid derived restraining force will be of a greater value.

This supply liquid derived force is actually applied over a larger face of the safety piston 43 than is normal to the extent that the value of the supply pressure at which the safety spring bias prevails is reduced to a level similar to, or lower than, normally designed residual pressures for safety means operation but more importantly the effects of variations in frictional resistance on such residual pressure operations are mitigated considerably.

In practice the residual supply level of pressure and force exerted by it on the safety piston are limited by practical considerations as to piston face area on which the liquid pressure acts so that it is advantageous if the component of the effective force due to the maximum frictional resistance of the slide member is designed to be as low as possible.

Bearing in mind variations in frictional resistance with supply liquid it will be appreciated that a suitable slide member could in operation have very low frictional resistance.

It was briefly discussed hereinbefore that low slide member frictional resistance has been considered detrimental to reliable valve operation where the slide member is unrestrained between control operations and to permit the safety means to operate, such a freely movable slide member being susceptible to displacement by external shocks, gravitational forces or fluctuations in supply pressure which may permit the safety piston to begin displacing the slide member before recovering, all of which can leave the slide member displaced from its first operating position and interfere with correct valve operation.

Referring again to FIG. 1 the valve 10 includes slide member position holding means which, when the slide member is moved into the vicinity of the first operating position (at which to the function port is exposed to supply pressure within the aperture means), latches the slide member into the first operating position until displaced upon operation of the valve by the control means, that is, fluid pressure on piston formation 13", or by the safety piston 37 under the action of the bias spring 38.

The holding means provides a force biasing or holding the slide member in the first operating position and preventing the slide member, which may have low sliding resistance, from being disturbed from the first operating position by external shocks or forces as considered above.

The position holding means, shown generally at 45, comprises a holding piston 46 disposed in a holding cylinder 47 in the valve body adjacent the second operating position of the slide member and aligned with the slide chamber so that the holding piston can reciprocate in the same directions as the slide member.

The holding cylinder is arranged to receive and vent fluid via line 48 by holding control means shown in FIGS. 1 and 2 as comprising a holding port 49 for the line 48 into the slide chamber which is arranged to receive fluid from the supply port 25 at substantially the same pressure as the function port 26. As shown in FIG. 2 the holding port is disposed adjacent the function port 26 within the boundary of the annular sealing land 34 at the first operating position and having regard to displacement of this land with displacement of the slide member.

As will be seen from the broken and chain dotted lines representing the sealing land at successive displacements of the slide member the holding and function ports are subjected to substantially the same liquid pressures, being either both connected to the pressurised supply line port 25 by way of the aperture means or both vented into the slide chamber.

It will be seen from the Figures that when the slide member is moved from its second operating position by the fluid pressure of the control means in cylinder 14' the liquid within the slide chamber and holding cylinder is at return line pressure so that the control fluid pressure acts on both the face of the holding piston 46 to keep it within the holding cylinder and on the full face of the piston formation 13' of the slide member.

When the slide member has been displaced to the vicinity of the first operating position and the holding port 49 is, with the function port 26, subjected to supply fluid pressures, the holding piston is forced from the holding cylinder into contact with the slide member and the pressure of the valve supply liquid maintains the holding bias force thereon, despite removal of the transient operating force, to resist any tendency for displacement of the slide member by external forces. Thus the holding control means is arranged only to connect the holding cylinder to the source of fluid pressure when the slide member is in the vicinity of the first operating position. At all other positions the holding control means vents the holding cylinder fluid pressure.

The holding piston area is chosen with regard to the supply fluid pressure to provide a holding bias force on the slide member which is less than the normal value of operating forces applied to the slide member by the fluid of the control means, that is, the operating force can displace the slide member against the holding bias.

It will be seen that in normal operation closure of the valve by the control means requires that the force exerted on piston formation 13" by control fluid pressure initially displaces both the slide member and holding piston against the bias exerted by the holding piston.

It will be appreciated that as movement of the slide member is effected by transient application of fluid pressure through pilot valve 15" the control force only exists for a limited time period and holding pressure not released before the end of control force can bias the slide member back into the first operating position. Accordingly, it is important that holding cylinder fluid pressure be vented efficiently within the duration of the transient control force application.

It will be seen from the Figures that in the arrangement 10, in response to the slide member leaving the vicinity of the first operating position the holding port 49 is vented, with but independently of, function port 26, into the slide chamber and substantial resistance to motion reduced to the frictional resistance level with no chance of residual holding bias returning the slide member to the first operating position after the control force has finished and before the function line has depressurised.

Considering operation of the safety means it will be seen that the safety bias force exerted by safety spring 38 is normally at least balanced, and its extension prevented, by the force exerted by the supply liquid pressure on the safety piston face 43, the effective frictional resistance force of the slide member and the bias force of the holding means and that the safety means will operate only when the sum of these forces falls below the force exerted by the safety spring.

When the slide member is in the first operating position and biased there by the force on the holding piston it will be seen that the valve closing force of the safety spring is overcome by the force derived from the supply liquid pressure acting on both the face 43 of the safety piston and on the holding piston 46, that is, the holding piston effectively comprises an area extension of safety piston face 43 whilst using some of the force overcoming the safety spring to hold the slide member in position against any external forces.

If the pressure of valve supply liquid in line 22 falls then the forces exerted directly on safety piston face 43 and on holding piston 46 fall together until at some residual pressure level dependent on the effective piston area and upon the force needed to overcome slide member frictional resistance the safety spring 38 overcomes these forces and begins to move the slide member to the second operating position and close the valve.

Because the holding pressure may be more accurately defined, and much larger than the maximum effective frictional resistance force it aids, the strength of the spring may be chosen so that it is able to trip for a better defined level of residual supply liquid pressure in cylinder 40. In this respect the holding and spring forces may be considerably larger than the spring force associated purely with overcoming frictional resistance and residual liquid pressure in cylinder 40.

Whatever the residual supply pressure remaining after the safety means has operated displacement of the slide member from the first operating position vents the holding cylinder and may contribute some useful reduction to the total forces opposing the safety spring as it extends whereby any decrease of spring force with extension will not affect its ability to complete movement of the slide member to the second operating position. Looked at another way, as reduction of spring force with extension does not have to be added to the supply liquid residual force at which tripping occurs the tripping can be more accurately related to the maximum frictional resistance of the slide member.

It will be appreciated that prior to the safety means actually displacing the slide member from its first operating position the holding bias exerted on the slide member by the holding piston to protect it from unwanted displacements is transmitted to the safety piston 37 where it supplements the supply-liquid-derived force acting of safety piston face 43. The holding piston, in comprising an effective area extension of the safety piston, enables as an alternative to an increase in the force at which the safety spring prevails a decrease in the residual supply pressure at which the force is developed from that where safety piston face 43 is the sole source of liquid-derived restraining force.

The valve construction shown in FIG. 1, in which the safety piston 37 forms an end wall of cylinder 14'' and defines the first operating position of the slide member, is convenient to use and simplifies the manufacture. It will be appreciated, as the sectional elevation of FIG. 3 shows, that the supply piston 37' may be made of a different diameter than the slide member piston formation 13'' and/or that the first position of the slide member may be defined by other means such as abutment with a conventional cylinder wall 14''.

When the safety piston does not define the slide member operating position, it may assume a normal position in which it is physically displaced from the slide member. The holding bias force is then not transmitted to the safety piston in normal operation but when the supply liquid pressure falls the safety piston moves under the action of the spring until it contacts the slide member when both of the liquid-derived forces have to be overcome by the spring as described above for the safety means to operate completely.

It will be further appreciated from FIGS. 1 and 3 that with normal supply liquid pressure the holding piston acts on the slide member to prevent unwanted displacement and the safety piston performs no function other than to keep the safety spring compressed by the action of this normal supply pressure. When supply pressure falls it falls on both the holding and safety pistons and the combined forces it generates determine when the safety means operates.

Accordingly, provided the liquid-derived force exerted on the safety piston face 43 at normal operating pressure, or within any range of permissible pressure fluctuations, is as great as the spring force chosen to prevail at lower residual pressures, most of the spring restraining force, considered in circumstances of low fluid pressure when the safety means operates, may be provided by the holding means through the holding piston rather than an enlarged safety piston area. This force must, of course, be less than the normal control force exerted on the slide member by control fluid pressure in cylinder 14''.

Such as arrangement is effective in maintaining the safety spring in a continuously compressed state. However where it is considered acceptable for the safety spring to cycle between compression and relaxation with each operation of the valve at normal supply liquid pressure, it will be understood that the liquid derived force exerted directly on the safety piston face 43 need not be greater than the spring force, permitting the safety spring to extend with each displacment of the slide member from the first operating position by the control means and to compress again with displacement of the slide member to the first operating position.

The proportion of the total liquid-derived restraining force on the safety means, which determines its operation at low supply pressure, provided by the holding means and transmitted through the slide member is thus increased at the expense of the force derived from liquid pressure acting directly on the safety piston.

This mode of operation, in which the safety spring is permitted to cycle with normal valve operation and the holding piston provides a greater proportion of the safety means restraining force, may be taken further, as shown in the sectional elevations of FIG. 4(*a*) and 4(*b*), by having no safety piston on which supply liquid pressure is exerted directly but a safety member 37'' which acts purely as a guide for the safety spring 38. It will be seen that in appropriate constructions the spring may operate directly on the slide member with no intervening member 37''.

FIG. 4(*a*) shows the valve open with the slide member in the first operating position and safety spring compressed and FIG. 4(*b*) shows, by comparison, the valve closed with the slide member in the second operating position and the safety spring extended. This disposition pertains whether the valve is closed by the control means at normal supply pressure or by the safety means upon supply pressure failure.

All of the restraining force which acts to overcome the spring force when the supply liquid pressure falls is now supplied by way of the holding piston and the slide member and at normal supply pressure this restrains not only the safety spring but also the slide member against unwanted displacements, irrespective of how low the frictional resistance is.

It will be appreciated that parts of the holding means, namely the holding piston and cylinder combination, may be varied from that described above.

Referring to FIG. 5 this shows in section elevation the slide member piston formation 13' an control cylinder 14' in valve body 11. The holding cylinder 47 is formed as before in the end of control cylinder 14' but the holding piston, shown as 46', is formed as an extension of the slide member. The valve arrangement functions generally as described above except that when the slide member is displaced from the second to first operating position the force exerted by fluid pressure in control cylinder 14' is limited by the rather smaller annular face to the piston formation.

If overall valve dimensions are limited and prohibit disposition of a holding cylinder as shown at 47 in FIGS. 1 and 4 the arrangement shown in FIG. 6 may be used wherein the cylinder 47'' is formed within the body of the slide member and the piston 46'' is fixed in relation to the valve body.

Other configurations may be considered which are not shown but whose configurations will be apparent from the illustrations to those of ordinary skill; for example, the holding piston may act not along the direction of sliding of the slide member but at an angle to an end or side face thereof providing a bias force to the slide member in the first operating position an resistance to initial displacement therefrom which falls as soon as the slide member has left at least the vicinity of the first operating postion.

The principles involved may of course be employed with valves of other constructional details as to slide member, aperture means and porting arrangements and where means other than the pilot valve/control fluid pressure is used to apply a control force to the slide member to effect its displacement.

What is claimed:

1. A bistable hydraulic slide valve comprising a body, including a slide chamber in the body supply, return and function ports to the chamber supply, return and function lines connected to the respective ports, an apertured slide member reciprocable in the slide chamber between a first operating position, at which the function port is coupled to the supply port, and a second operating position, at which the function port is coupled to the return port, valve control means responsive to control signals when the slide member is in one operating position to apply operating force at least temporarily to the slide member to slide it to the alternative operating position, safety means including a safety spring operable to exert a safety bias force in a direction to move the slide member from the first operating position and safety piston means responsive, at least when the slide member is in the vicinity of the first operating position, to a supply liquid pressure thereon greater than a safety tripping value to exert a restraining force on the safety spring greater than the spring safety bias force, and slide member position holding means comprising a holding cylinder, a holding piston disposed therein and holding control means, comprising a holding port into the slide chamber and a liquid flow line between the holding port and the holding cylinder, responsive to the slide member being at least in the vicinity of the first operating position to couple the holding cylinder to fluid from the supply port at a pressure which exerts by separation of holding piston and cylinder a holding force biasing the slide member to the first operating position which, upon operation of the valve, is less than normal valve operating forces applied to the slide member and responsive to the slide member being displaced from said vicinity of the first operating position by said valve operating forces to vent the holding cylinder fluid pressure into the slide chamber and eliminate the holding bias force, wherein when the slide member is in the vicinity of the first operating position, the supply port is coupled to the function port by way of the aperture in the slide member and the holding port is disposed adjacent the function port and aligned with the aperture to receive from the supply port liquid at the same pressure as the function port and in which the supply port is dimensioned and disposed with respect to the aperture so that the liquid at supply line pressure is ported into the aperture so that the liquid at supply line pressure is ported into the aperture for all positions of the slide member, the return line is disposed so that it is ported into the slide chamber for all positions of the slide member and the function and holding lines are ported into the slide chamber such that when the slide member is in the vicinity of the first position they are aligned with the other end of the aperture and isolated from the slide chamber.

2. A bistable hydraulic slide valve comprising a body, including a slide chamber in the body supply, return and function ports to the chamber supply, return and function lines connected to the respective ports, and apertured slide member reciprocable in the slide chamber between a first operating position, at which the function port is coupled to the supply port, and a second operating position, at which the function port is coupled to the return port, valve control means responsive to control signals when the slide member is in one operating position to apply operating force at least temporarily to the slide member to slide it to the alternative operating position, safety means including a safety spring operable to exert a safety bias force in a direction to move the slide member from the first operating position and safety piston means responsive, at least when the slide member is in the vicinity of the first operating position, to a supply liquid pressure thereon greater than a safety tripping value to exert a restraining force on the safety spring greater than the spring safety bias force, and slide member position holding means comprising a holding cylinder, a holding piston disposed therein and holding control means, comprising a holding port into the slide chamber and a liquid flow line between the holding port and the holding cylinder, responsive to the slide member being at least in the vicinity of the first operating position to couple the holding cylinder to fluid from the supply port at a pressure which exerts by separation of holding piston and cylinder a holding force biasing the slide member to the first operating position which, upon operation of the valve, is less than normal valve operating forces applied to the slide member and responsive to the slide member being displaced from said vicinity of the first operating position by said valve operating forces to vent the holding cylinder fluid pressure into the slide chamber and eliminate the holding bias force, in which the apertured slide member comprises aperture means comprising said aperture extending through the slide member across the direction of slide in the slide chamber and containing at each end thereof a shear seal axially movable in the through aperture and biased outwardly with respect to the other seal by an intermediate resilient member to sealingly contact the opposing slide chamber walls, each shear seal comprising a hollow tubular member having at each end thereof an annular face, the face engaging the slide chamber wall forming a sealing land of smaller area than the face within the aperture and isolating any port opening thereinto from the slide chamber.

3. A bistable hydraulic slide valve comprising a body, including a slide chamber in the body supply, return and function ports to the chamber supply, return and function lines connected to the respective ports, an apertured slide member reciprocable in the slide chamber between a first operating position, at which the function port is coupled to the supply port, and a second operating position, at which the function port is coupled to the return port, valve control means responsive to control signals when the slide member is in one operating position to apply an operating force at least temporarily to the slide member to slide it to the alternative operating position, safety means including a safety spring operable to exert a safety bias force in a direction to move the slide member from the first operating position and safety piston means responsive, at least when the slide member is in the vicinity of the first operating position, to a supply liquid pressure thereon greater than a safety tripping value to exert a restraining force on the safety spring greater than the spring safety bias force, and slide member position holding means comprising a holding cylinder, a holding piston disposed therein and holding control means, comprising a holding port in to the slide chamber and a liquid flow line between the holding port and the holding cylinder, responsive to the slide member being at least in the vicinity of the first operating position to couple the holding cylinder to fluid from the supply port at a pressure which exerts by separation of holding piston and cylinder a holding force biasing the slide member to the first operating position which, upon operating of the valve, is less than normal valve operating forces applied to the slide member and responsive to the slide member being displaced from said vicinity of the first operating position by said valve operating forces to vent the holding cylinder fluid pressure into the slide chamber and eliminate the holding bias force, further wherein the safety piston means comprises a safety piston, disposed between the safety spring and the slide member and on which supply liquid acts to oppose the force of the safety spring on the slide member and the holding piston, the force exerted on both pistons by the supply liquid defining the restraining force determining safety tripping value of the supply pressure.

4. A bistable hydraulic slide valve comprising a body, including a slide chamber in the body supply, return and function ports to the chamber supply, return and function lines connected to the respective ports, an apertured slide member reciprocable in the slide chamber between a first operating position, at which the function port is coupled to the supply port, and a second operating position, at which the function port is coupled to the return port, valve control means responsive to control signals when the slide member is in one operating position to apply operating force at least temporarily to the slide member to slide it to the alternative operating position, safety means including a safety spring operable to exert a safety bias force in a direction to move the slide member from the first operating position and safety piston means responsive, at least when the slide member is in the vicinity of the first operating position, to a supply liquid pressure thereon greater than a safety tripping value to exert a restraining force on the safety spring greater than the spring safety bias force, and slide member position holding means comprising a holding cylinder, a holding piston disposed therein and holding control means, comprising a holding port into the slide chamber and a liquid flow line between the holding port and the holding cylinder, responsive to the slide member being at least in the vicinity of the first operating position to couple the holding cylinder to fluid from the supply port at a pressure which exerts by separation of holding piston and cylinder a holding force biasing the slide member to the first operating position which, upon operation of the valve, is less than normal valve operating forces applied to the slide member and responsive to the slide member being displace from said vicinity of the first operation position by said valve operating forces to vent the holding cylinder fluid pressure into the slide chamber and eliminate the holding bias force, and in which the holding piston is separate from the slide member and arranged to remain within the holding cylinder as the slide member is operably displaced by the valve control means from the second operating position to the vicinity of the first operating position and then, by operation of the holding control means, is displaced by fluid pressure in the holding cylinder into abutment with the slide member.

5. A bistable hydraulic slide valve comprising a body, including a slide chamber in the body supply, return and function ports to the chamber supply, return and function lines connected to the respective ports, an apertured slide member reciprocable in the slide chamber between a first operating position, at which the function port is coupled to the supply port, and a second operating position, at which the function port is coupled to the return port, valve control means responsive to control signals when the slide member is in one operating position to apply operating force at least temporarily to the slide member to slide it to the alternative operating position, safety means including a safety spring operable to exert a safety bias force in a direction to move the slide member from the first operating position and safety piston means responsive, at least when the slide member is in the vicinity of the first operating position, to a supply liquid pressure thereon greater than a safety tripping value to exert a restraining force on the safety spring greater than the spring safety bias force, and slide member position holding means comprising a holding cylinde, a holding piston disposed therein and holding control means, comprising a holding port into the slide chamber and a liquid flow line between the holding port and the holding cylinder, responsive to the slide member being at least in the vicinity of the first operating position to couple the holding cylinder to fluid from the supply port at a pressure which exerts by separation of holding piston and cylinder a holding force biasing the slide member to the first operating position which, upon operation of the valve, is less than normal valve operating forces applied to the slide member and responsive to the slide member being displaced from said vicinity of the first operating position by said valve operating forces to vent the holding cylinder fluid pressure into the slide chamber and eliminate the holding bias force, in which the holding cylinder is disposed in the body adjacent the second position of the slide member and the holding piston is arranged to reciprocate therein the direction of reciprocation of the slide member, and in which the valve control means comprises a piston formation at each end of the slide member, corresponding cylinders to contain each piston formation and pilot valve means arranged to vent the cylinders normally and be energisable temporarily to couple one only of the cylinders at a time to a supply of pressurized fluid, whereby only for the duration of said pilot valve energisation the piston formation is subjected to an actuating force which displaces the slide member to the alternative operating position and the other piston formation displaces fluid from its associated cylinder by way of the pilot valve means, and in which the holding piston is arranged to apply its bias force to the end of the piston formation of the slide member which effects control displacement of the slide member from the second operation position.

* * * * *